US011798443B1

(12) United States Patent
Janik

(10) Patent No.: US 11,798,443 B1
(45) Date of Patent: Oct. 24, 2023

(54) HAZARD WARNING SYSTEM

(71) Applicant: Eric M. Janik, Pasadena, MD (US)

(72) Inventor: Eric M. Janik, Pasadena, MD (US)

(73) Assignee: Eric Janir, Pasadena, MD (US)

( * ) Notice: Subject to any disclaimer, the term of this patent is extended or adjusted under 35 U.S.C. 154(b) by 0 days.

(21) Appl. No.: 18/148,150

(22) Filed: Dec. 29, 2022

(51) Int. Cl.
*G09F 13/04* (2006.01)
*G09F 21/04* (2006.01)
*G09F 27/00* (2006.01)

(52) U.S. Cl.
CPC ..... *G09F 13/0445* (2021.05); *G09F 21/048* (2013.01); *G09F 27/004* (2013.01); *G09F 27/005* (2013.01)

(58) Field of Classification Search
CPC ... G09F 13/0445; G09F 21/048; G09F 27/004
See application file for complete search history.

(56) References Cited

U.S. PATENT DOCUMENTS 5,238,281 A 8/1993 Chen
6,734,792 B1 * 5/2004 McElveen ..... B60Q 1/545 340/472
6,886,968 B1 * 5/2005 Hamelink ..... B60R 9/06 280/491.2
7,171,773 B2 * 2/2007 Haggard, Jr. ..... G09F 21/042 40/604
7,347,017 B2 * 3/2008 Shaffer, Jr. ..... G09F 21/04 40/606.03
7,424,844 B2 9/2008 Carter
7,493,844 B2 2/2009 Martin
7,503,135 B2 * 3/2009 Chafin ..... G09F 21/04 40/607.04
7,861,903 B2 * 1/2011 Plaschka ..... B60R 9/06 224/532
7,934,445 B2 5/2011 McClellan
9,015,972 B1 * 4/2015 Morgan ..... G09F 21/048 40/591
9,135,842 B1 9/2015 Riley et al.
9,170,072 B1 10/2015 Riggs
9,189,980 B2 * 11/2015 Kidd ..... G09F 17/00
9,694,759 B1 * 7/2017 VanAmburgh ..... B60R 9/08
10,636,335 B2 4/2020 Kis-Benedek Pinero et al.
10,907,777 B2 * 2/2021 Paine ..... F21V 21/22
10,950,151 B2 3/2021 Sanchez et al.
2003/0164436 A1 * 9/2003 Rooker ..... G09F 21/04 248/441.1
2006/0143957 A1 7/2006 Salehi
2006/0191180 A1 8/2006 Williams et al.
2006/0265922 A1 * 11/2006 Shaffer ..... G09F 21/04 40/591
2008/0073398 A1 * 3/2008 Plaschka ..... B60R 9/06 224/532
2009/0019748 A1 1/2009 Rosarius
2009/0064552 A1 * 3/2009 Columbia ..... G09F 21/048 40/591
2011/0179684 A1 7/2011 Blaho
(Continued)

*Primary Examiner* — Gary C Hoge

(57) ABSTRACT

A hazard warning system having a display panel operatively associated with two mounting elements. One mounting element is adapted for coupling to a trailer hitch, and another mounting element is adapted for engaging a ground-supported frame. The display panel is configurable to alert and instruct the public in real time.

7 Claims, 4 Drawing Sheets

(56) References Cited

U.S. PATENT DOCUMENTS

| | | | | |
|---|---|---|---|---|
| 2012/0303458 | A1 | 11/2012 | Schuler, Jr. | |
| 2017/0114966 | A1* | 4/2017 | McCurdy | B60D 1/58 |
| 2017/0158146 | A1* | 6/2017 | Livingston | G03B 29/00 |
| 2019/0141280 | A1* | 5/2019 | Bottomly | G09F 21/048 |
| 2020/0223354 | A1 | 7/2020 | Yun | |
| 2021/0225267 | A1 | 7/2021 | Thielemans et al. | |
| 2022/0048440 | A1* | 2/2022 | Hockly | G09F 9/30 |
| 2022/0138807 | A1* | 5/2022 | Penaflor | G06Q 30/0277 705/14.73 |
| 2022/0169272 | A1* | 6/2022 | Jablovski | B60W 50/14 |

* cited by examiner

HAZARD WARNING SYSTEM

BACKGROUND OF THE INVENTION

The present invention relates to hazard warning systems and, more particularly, a hitch-mountable hazard warning system embodied in a unitary assembly mountable to a vehicle hitch or a stand-alone frame.

Vehicular hazard warning devices can be critical to preventing accidents and saving lives; however, their deployment can be difficult. Typically, hazard warning devices require two or more people to install and demanding assembly of different parts while the attached vehicle is lifted or jacked up. In other words, the manpower needed to set up warning devices is a waste of resources.

As can be seen, there is a need for a hazard warning system embodied in a hazard warning that is mobile, portable, hitch-mountable, LED-enabled, wireless, camera-enabled, amber alert-enabled and traffic notification-enabled, wherein the hazard warning assembly is hitch-mountable to SUVs, cars, trucks, golf carts, boats or any vehicle having a hitch. The hazard warning assembly is also configured to be mountable to a stand-alone frame in lieu of a vehicle.

SUMMARY OF THE INVENTION

At the heart of the invention, is a vehicular hazard warning assembly that is adapted to be efficiently transferable between any hitch equipped vehicle by way of a hitch attachment point and stand-alone frame by a second attachment point.

The vehicular hazard warning assembly is adapted for use by first responders by being configurable to alert and instruct the public through a display panel system enabled to notify people of amber alerts in real time The vehicular hazard warning assembly assists public works and small work crews through the display panel system that can visually convey traffic control instructions.

The present invention is geared, as well, for do-it-yourselfers since there is no need to jack up the vehicle during installation, making installation a one-person job. Likewise, the vehicular hazard warning assembly may be used as a moving billboard by do-it-yourselfers.

The vehicular hazard warning assembly may provide a closed-circuit-television (CCTV) surveillance system.

The display panel system provides an advance warning LED display.

The vehicular hazard warning device may also serve as a ballistic and projectile deflection assistance system.

The multi-purpose hitch-mountable digital display that can be transferred between a vehicle hitch and its own static stand. The digital display panel may be integrated with an independent power source and wireless communication components.

The hazard warning system is adapted to be deployable in matter of minutes by a single user.

Necessary components include a hitch-mounted casing, LED display and power supply. A stand-alone chassis for vehicle to ground deployment may be provided, wherein the stand-alone chassis has off-road wheels, deflection shield, one or more armor portable shields, and a hard case.

The LED digital display may be utilized for traffic control or as moving billboards that can be strategically deployed to make the message conveyed by the LED digital display clear and direct.

The present invention is known as the Vehicle Advisory and Location Information System (or VALIS). VALIS provides a high-resolution color LED display panel that can be set up to display messages warranted for any situation. The LED display can be easily attached to any standard hitch receiver. Aside from standard vehicles, the VALIS can also be utilized on buses, trucks, vessels, ATVs, golf carts, snow mobiles, trains, RVs, and anything with a hitch.

The display panel of VALIS may include a high-resolution mobile display with built-in wireless network communication. The display panel may include a flash drive port for pre-programmed messages. The VALIS may be constructed from ballistic resistant deflective steel as well as provide one or more removable upper ballistic deflection bunker conversion shields with an adjustable suction handle for placement and manipulation. The VALIS may include a self-contained power supply, having USB ports/solar/ion power rechargeable solar generator of various wattages and power output so that the display panel may display constantly over fifteen hours. The display panel may include a WIFI-enabled color-display pan zoom mobile tracking night vision dual audio camera system. The display panel may be configurable to provide alarm notifications.

The VALIS may be manufactured from steel, laser cut design with an installed of camera system and LED display inside casing. The ballistic plates may be added separately with a manufactured cut butterfly personal shield design. Optional accessories can be mounted onto the primary unit in seconds. The hazard warning system can be used for several different tasks.

Stand-alone WIFI and cellular communication enables the unit to be operated remotely and by a single person. No trailers and trucks needed to transport to and from locations.

In one aspect of the present invention, a hazard warning system provides a display panel operatively associated with two spaced apart mounting elements; the two mounting elements include: a hitch interface configured to couple to a trailer hitch; and a frame interface configured to couple to an upper surface of a frame.

In another aspect of the present invention, the hazard warning system, includes a display panel operatively associated with two spaced apart mounting elements; the two mounting elements providing a hitch interface configured to couple to a trailer hitch; and a frame interface configured to couple to an upper surface of a frame, wherein the hitch interface and the frame interface are configured so that while the upper surface of the frame is engaged by the frame interface, the hitch interface contacts a supporting surface supporting the frame, wherein the hitch interface comprises a L-shape having a vertical leg and a horizontal leg, and wherein the vertical leg is attached to a rear surface of the display panel; the frame interface further comprising a brace dimensioned to extend from the vertical leg to a distal end of the frame; the frame interface has U-shaped upper portions that circumscribe a removable power source; a ballistic shield removably attached along an upper surface of the display panel; an image capturing device attached to the display panel; and two or more wheels connectable to ends of two legs of the frame.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a hazard warning system having a display panel operatively associated with two mounting elements, one mounting element for coupled to a trailer hitch, and another mounting element for engaging a ground-supported frame. The display panel is configurable to visually alert and instruct the public in real time.

Figure 1:
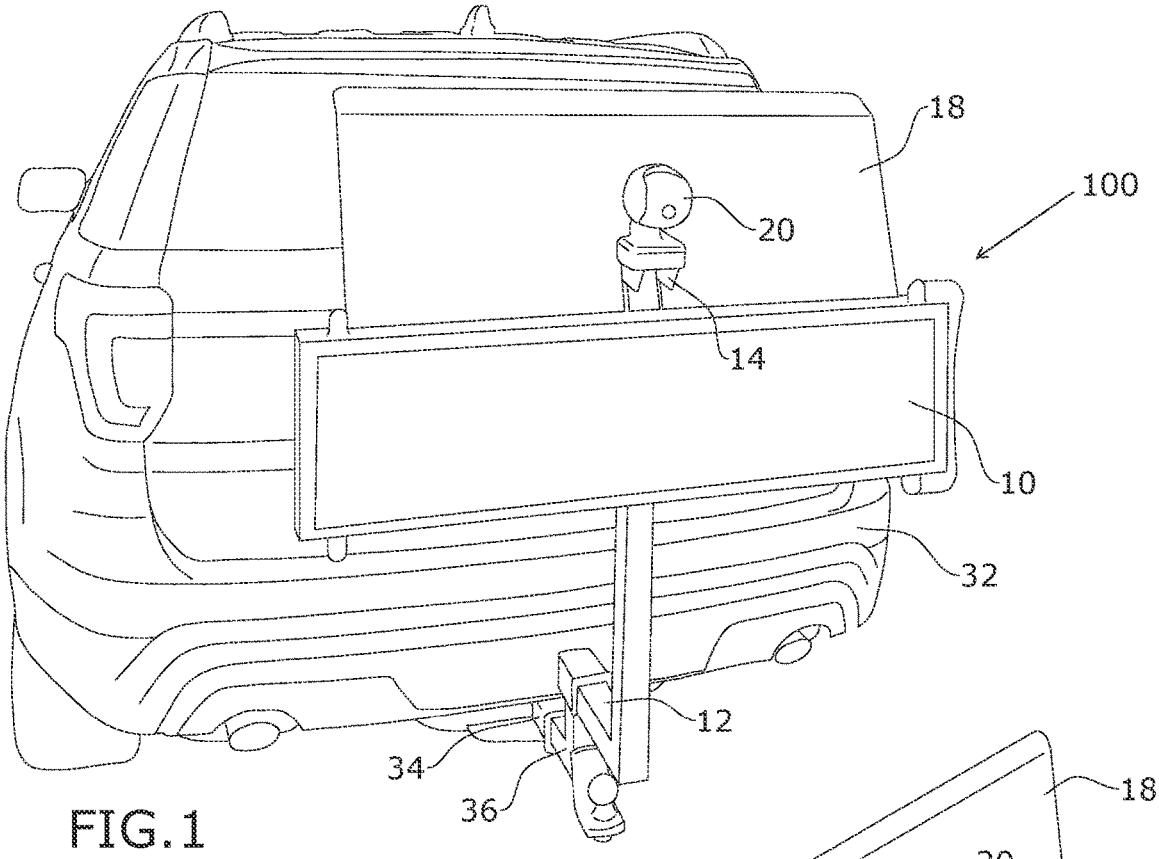
FIG. 1 is a perspective view of an exemplary embodiment of the present invention, shown in use mounted to a vehicle.
Figure 2:
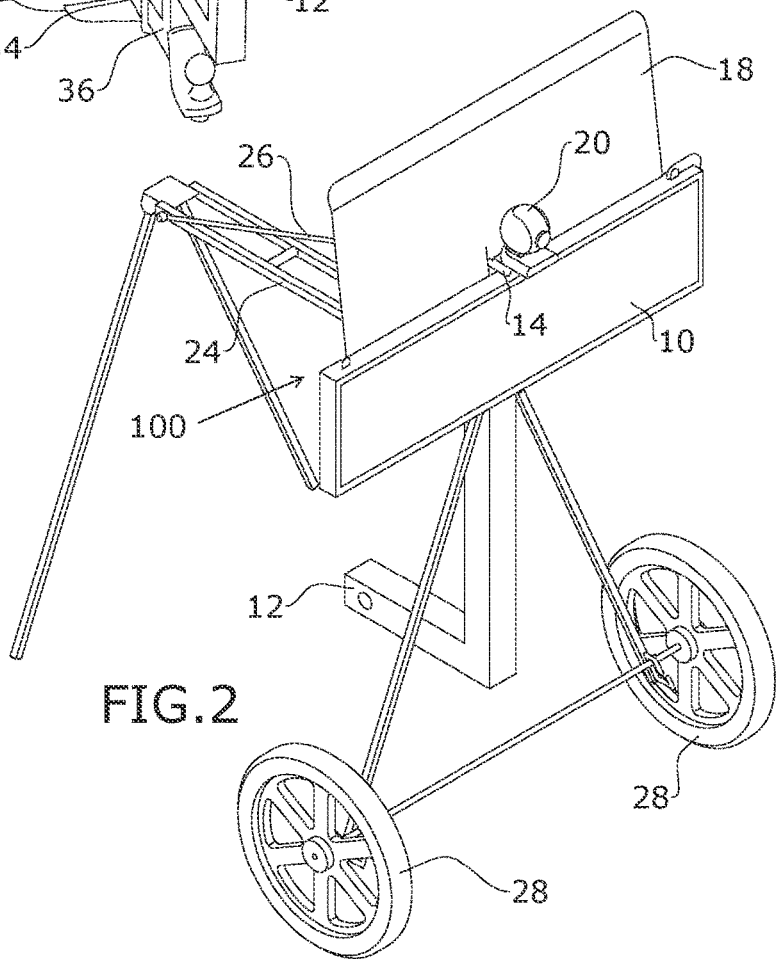
FIG. 2 is a perspective view of an exemplary embodiment of the present invention, shown in use mounted to a stand-alone frame
Figure 3:
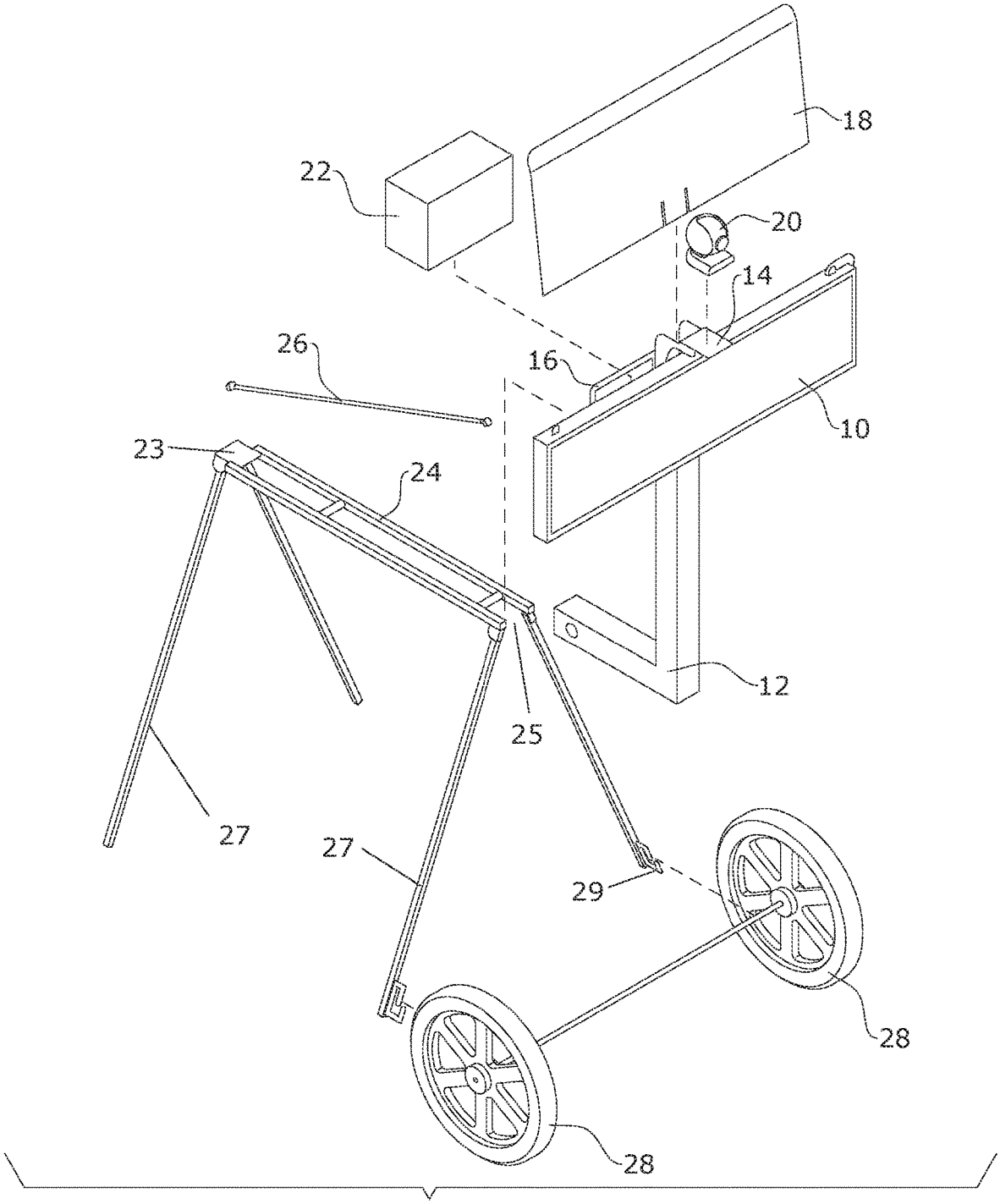
FIG. 3 is an exploded perspective view of FIG. 2.
Figure 4:
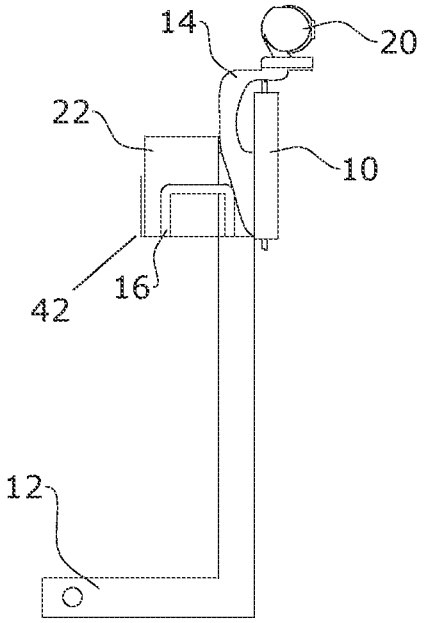
FIG. 4 is a side elevation view of an exemplary embodiment of the present invention.
Figure 5:
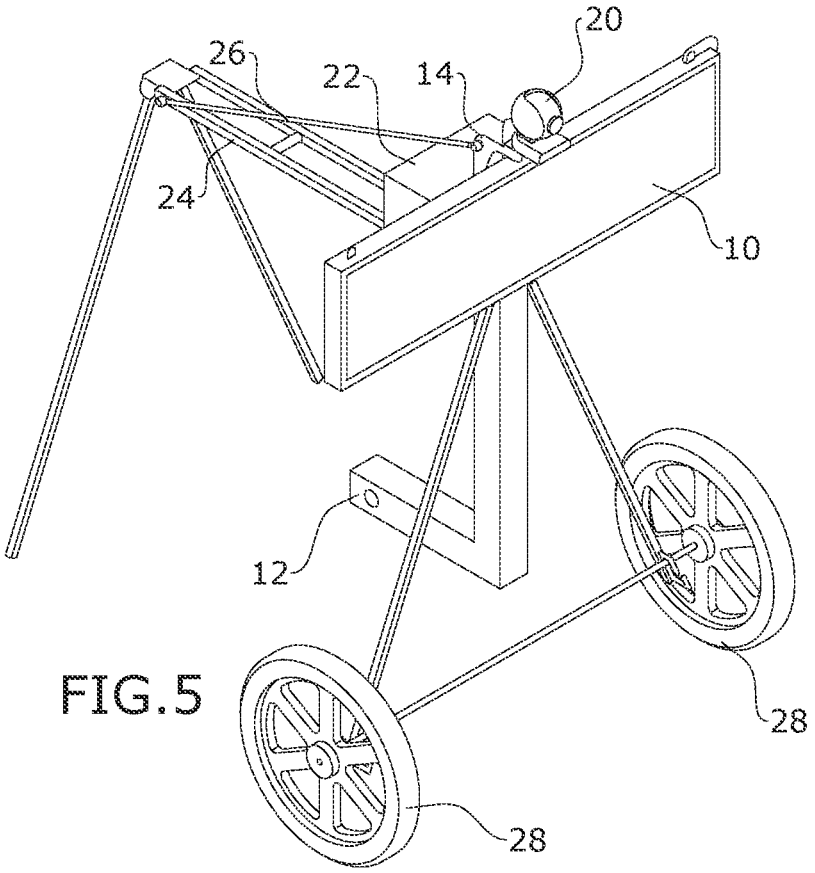
FIG. 5 is a top perspective view of an exemplary embodiment of the present invention.
Figure 6:
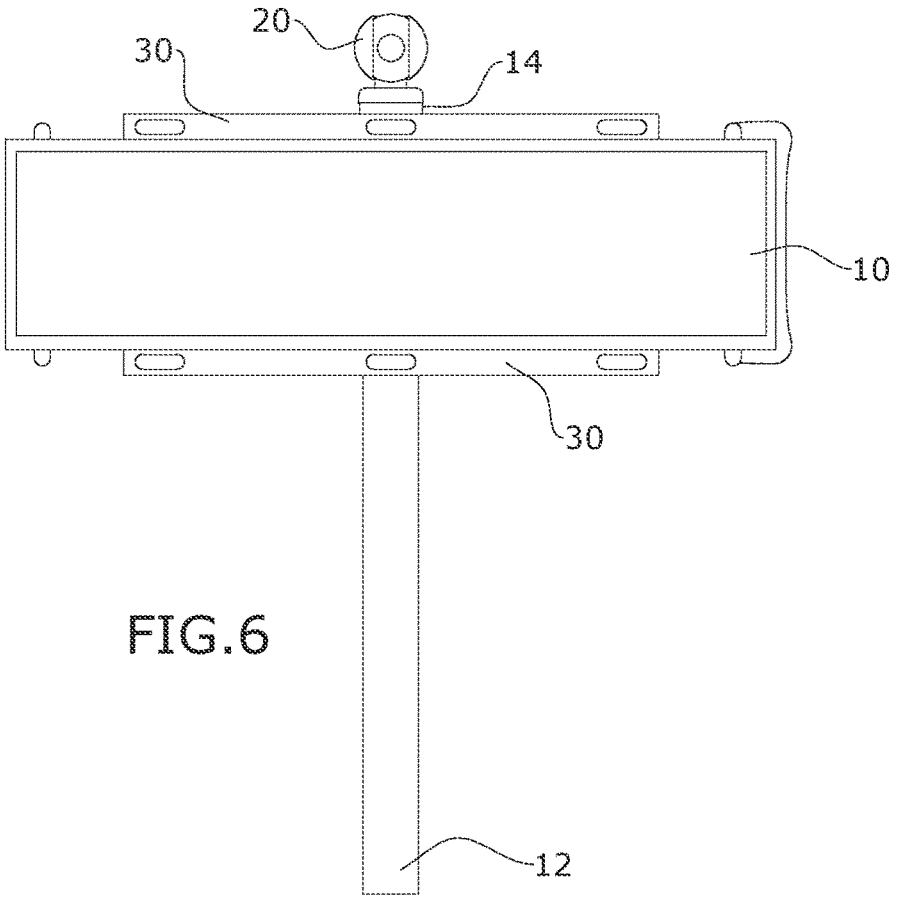
FIG. 6 is a front elevation view of an exemplary embodiment of the present invention.
Figure 7:
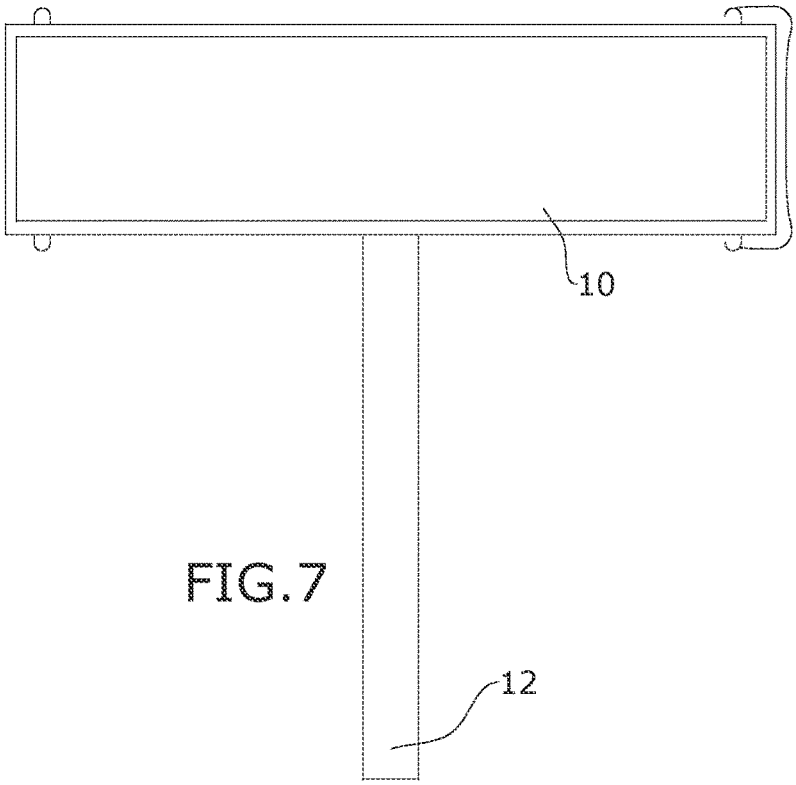
FIG. 7 is a front elevation view of an exemplary embodiment of the present invention.

Referring now to FIGS. 1 through 7, the present invention may include a hazard warning system 100. The hazard warning system 100 operatively associates a display panel 10 with two mounting elements. The first mounting element is a hitch interface 12 adapted to removable mount to a trailer hitch 34. The second mounting element is a frame interface 42 adapted to engage a frame 24. The display panel 10 may include a television (CCTV) surveillance system, LED and digital functionality, emergency lights 30, and an image-capturing device 20 mounted thereto by way of a camera mount 14. A ballistic shield 18 may be mounted to the display panel 10.

A power source 22 may be mounted to a rear surface of the display panel 10 by way of the frame interface 42. The frame interface 42 may project from said rear surface. A lower portion of the frame interface 42 may be a plate or the like. An upper portion of the frame interface 42 may provide U-shaped framing 16 perpendicularly extending from the lower portion for circumscribing the power source 22.

The hitch interface 12 may include a L-shaped member, wherein an upper portion of the vertical leg of the L-shaped member is attached to the rear surface of the display panel. The horizontal leg of the L-shaped member engages the trailer hitch 34 and/or a hitch adaptor 36 of a vehicle 32.

The frame 24 may extend from a distal end 23 to a proximal end 25. The frame 24 may have wheel 28 to assist in moving the frame 24 around by lifting the distal end 23 and rolling the frame 24 on its wheel 28. The wheels 28 may be connected to legs 27 of the frame 24 by way of wheel mounts 29.

The frame interface may include a brace 26 that extends from a distal end 23 of the frame 24 to the upper portion of the vertical leg of the L-shaped member. When the frame interface 42 is engaged with the proximal end 25 of the frame 24, the bottom of the horizontal leg of the hitch interface 12 may engage the same supporting surface of the legs 27 of the frame 24.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. Hazard warning system, comprising:

a display panel operatively associated with two spaced apart mounting elements;

the two mounting elements comprising:

a hitch interface configured to couple to a trailer hitch; and a frame interface configured to couple to an upper surface of a frame, wherein the hitch interface and the frame interface are configured so that while the upper surface of the frame is engaged by the frame interface, the hitch interface contacts a supporting surface supporting the frame.

2. The hazard warning system of claim 1, further comprising a ballistic shield removably attached along an upper surface of the display panel.

3. The hazard warning system of claim 1, wherein the hitch interface comprises a L-shape having a vertical leg and a horizontal leg, and wherein the vertical leg is attached to a rear surface of the display panel; and the frame interface further comprising a brace dimensioned to extend from the vertical leg to a distal end of the frame.

4. The hazard warning system of claim 1, wherein the frame interface has U-shaped upper portions that circumscribe a removable power source.

5. The hazard warning system of claim 1, wherein the frame comprises two or more wheels connectable to ends of two legs of the frame.

6. The hazard warning system of claim 1, wherein the display panel comprises an image capturing device attached thereto.

7. A hazard warning system, comprising:

a display panel operatively associated with two spaced apart mounting elements;

the two mounting elements comprising:

a hitch interface configured to couple to a trailer hitch; and a frame interface configured to couple to an upper surface of a frame, wherein the hitch interface and the frame interface are configured so that while the upper surface of the frame is engaged by the frame interface, the hitch interface contacts a supporting surface supporting the frame, wherein the hitch interface comprises a L-shape having a vertical leg and a horizontal leg, and wherein the vertical leg is attached to a rear surface of the display panel;

the frame interface further comprising a brace dimensioned to extend from the vertical leg to a distal end of the frame;

the frame interface has U-shaped upper portions that circumscribe a removable power source;

a ballistic shield removably attached along an upper surface of the display panel;

an image capturing device attached to the display panel; and two or more wheels connectable to ends of two legs of the frame.

* * * * *